US007876911B2

(12) United States Patent
Felder et al.

(10) Patent No.: US 7,876,911 B2
(45) Date of Patent: Jan. 25, 2011

(54) HEADPHONE DRIVER AND METHODS FOR USE THEREWITH

(75) Inventors: Matthew D. Felder, Austin, TX (US); Matthew Brady Henson, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 1339 days.

(21) Appl. No.: 11/389,780

(22) Filed: Mar. 27, 2006

(65) Prior Publication Data

US 2007/0223718 A1 Sep. 27, 2007

(51) Int. Cl.
*H04R 1/10* (2006.01)

(52) U.S. Cl. ..... 381/74

(58) Field of Classification Search ..... 381/74, 381/309, 1, 27, 55
See application file for complete search history.

(56) References Cited

U.S. PATENT DOCUMENTS

| | | | | |
|---|---|---|---|---|
| 3,984,885 | A * | 10/1976 | Yoshimura et al. | 381/309 |
| 5,617,477 | A * | 4/1997 | Boyden | 381/309 |
| 6,711,268 | B2 * | 3/2004 | Colegrave et al. | 381/74 |
| 6,856,046 | B1 * | 2/2005 | Scarlett et al. | 307/125 |
| 6,950,527 | B2 * | 9/2005 | Chu | 381/74 |
| 7,450,726 | B2 * | 11/2008 | Goyal | 381/74 |
| 7,502,478 | B2 * | 3/2009 | King | 381/55 |
| 2004/0091121 | A1 * | 5/2004 | Morimoto | 381/74 |
| 2007/0222522 | A1 * | 9/2007 | Delano et al. | 330/296 |

* cited by examiner

*Primary Examiner*—Curtis Kuntz
*Assistant Examiner*—Hai Phan
(74) *Attorney, Agent, or Firm*—Gary R. Stanford

(57) ABSTRACT

A headphone driver includes a driver module for generating a plurality of headphone driver signals including a filtered stereo sum signal.

10 Claims, 19 Drawing Sheets

HEADPHONE DRIVER AND METHODS FOR USE THEREWITH

TECHNICAL FIELD OF THE INVENTION

The present invention relates to headphone drivers as may be used in radio receivers and other electronic devices that produce an audio output, and related methods.

DESCRIPTION OF RELATED ART

As is known, integrated circuits are used in a wide variety of electronic equipment, including portable, or handheld, devices. Such handheld devices include AM/FM radios, computers, CD players, MP3 players, DVD players, cellular telephones, etc. Each of these handheld devices includes one or more integrated circuits to provide the functionality of the device.

As an example, a handheld FM radio receiver may include multiple integrated circuits to support the reception and processing of broadcast radio signals, in order to produce audio output signals that are delivered to the user through speakers, headphones or the like. In a stereo configuration, right and left channel signals are generated. A typical headphone driver includes right and left channel audio amplifiers that supply the power required to drive headphone elements, earbuds, etc.

It is desirable for a headphone driver to efficiently provide a high output power. The amount of power produced is dependent upon the maximum output swing of these devices. However, the supply voltage or voltages limit the output swing of the headphone driver.

The need exists for a headphone that produces high output power and that can be implemented efficiently on an integrated circuit.

DETAILED DESCRIPTION OF THE INVENTION INCLUDING THE PRESENTLY PREFERRED EMBODIMENTS

Figure 1:
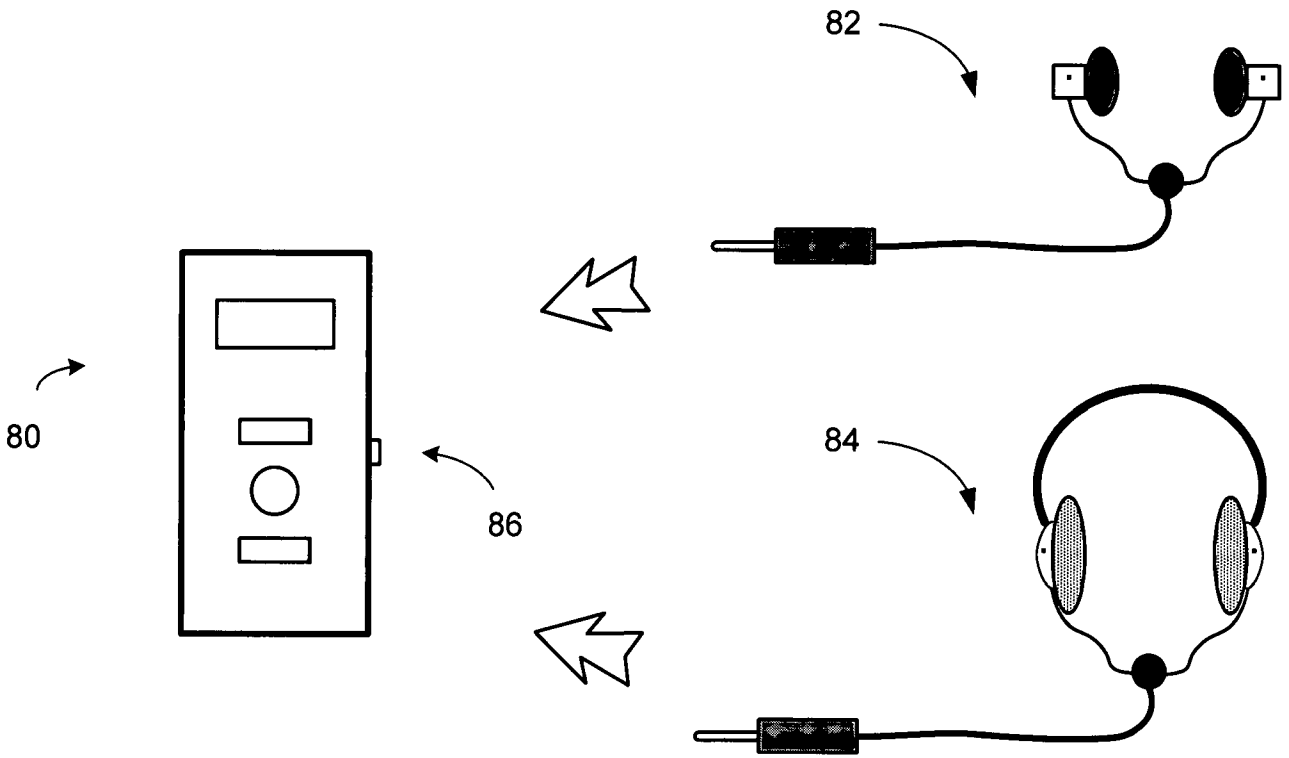
FIG. 1 presents a pictorial diagram of a handheld audio system in accordance with an embodiment of the present invention.

FIG. 1 presents a pictorial diagram of a handheld audio system in accordance with an embodiment of the present invention. In particular, a handheld audio system 80 is shown that receives a radio signal that carries at least one stereo audio channel that includes audio channel signals 104. Note that the audio channel signals 104 may be digital signals or analog signals. The received radio signal may be an AM radio signal, FM radio signal, satellite radio signal, cable radio signal, that carries at least one stereo audio channel. In operation, the handheld audio system 80 produces an audio output for a user by means of headphones 84, earbuds 82 or other speaker systems coupled to headphone jack 86. In addition to producing an audio output from the received radio signal, the handheld audio system 80 can optionally process stored MP3 files, stored WMA files, and/or other stored digital audio files to produce an audio output for the user. Handheld audio system 80 includes a headphone driver coupled to headphone jack 86 that implements one or more of the features and functions in accordance with an embodiment of the present invention as set forth further in conjunction with the remaining figures and the appended claims.

Figure 2:
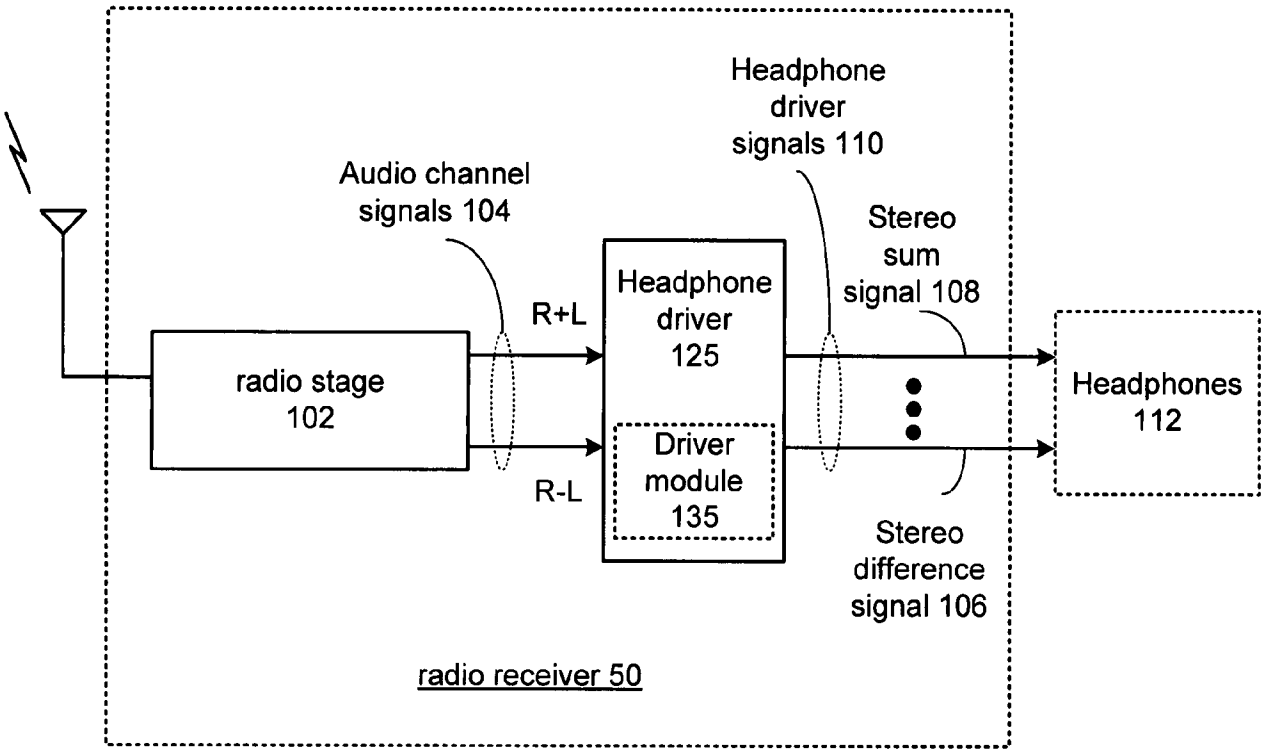
FIG. 2 presents a schematic block diagram of a radio receiver in accordance with an embodiment of the present invention.

FIG. 2 presents a schematic block diagram of a radio receiver in accordance with an embodiment of the present invention. In particular, radio receiver 50 includes a radio stage 102 that receives and demodulates a received radio signal. In an embodiment of the present invention, the radio signal includes a frequency modulated (FM) stereo broadcast signal that includes a stereo sum signal, the sum of right and left channel signals (R+L), and includes a stereo difference signal, the difference of right and left channel signals (R−L). As used herein stereo sum signal means any signal that includes the sum of two or more audio channel signals, regardless of polarity, and scaling. As used herein stereo difference signal means any signal that includes the difference between two or more audio channel signals, regardless of polarity, and scaling. As used herein, right and left channel signals mean, respectively, any signal that includes predominately one audio channel of a multi-channel audio encoding scheme, regardless of polarity, and scaling. It should be noted throughout this description that the polarities and/or phases of the various signals described herein are referenced with respect to the other signals. The polarities and/or phases of a signal can be modified with a commensurate modification of polarities and/or phases of the other signals present. In addition, while polarity inversions are presented herein at a particular points in a circuit, these polarity inversions can likewise occur at other points along a signal path or be implemented by multiple inversions and/or phase shifts.

In an embodiment of the present invention, radio stage 102 produces audio channel signals 104 that include stereo sum signal (R+L) and stereo difference signal (R−L). Headphone driver 125 includes a driver module 135 for generating a plurality of headphone driver signals 110 that include a stereo sum signal 108 and a stereo difference signal 106, for driving headphones 112.

Figure 3:
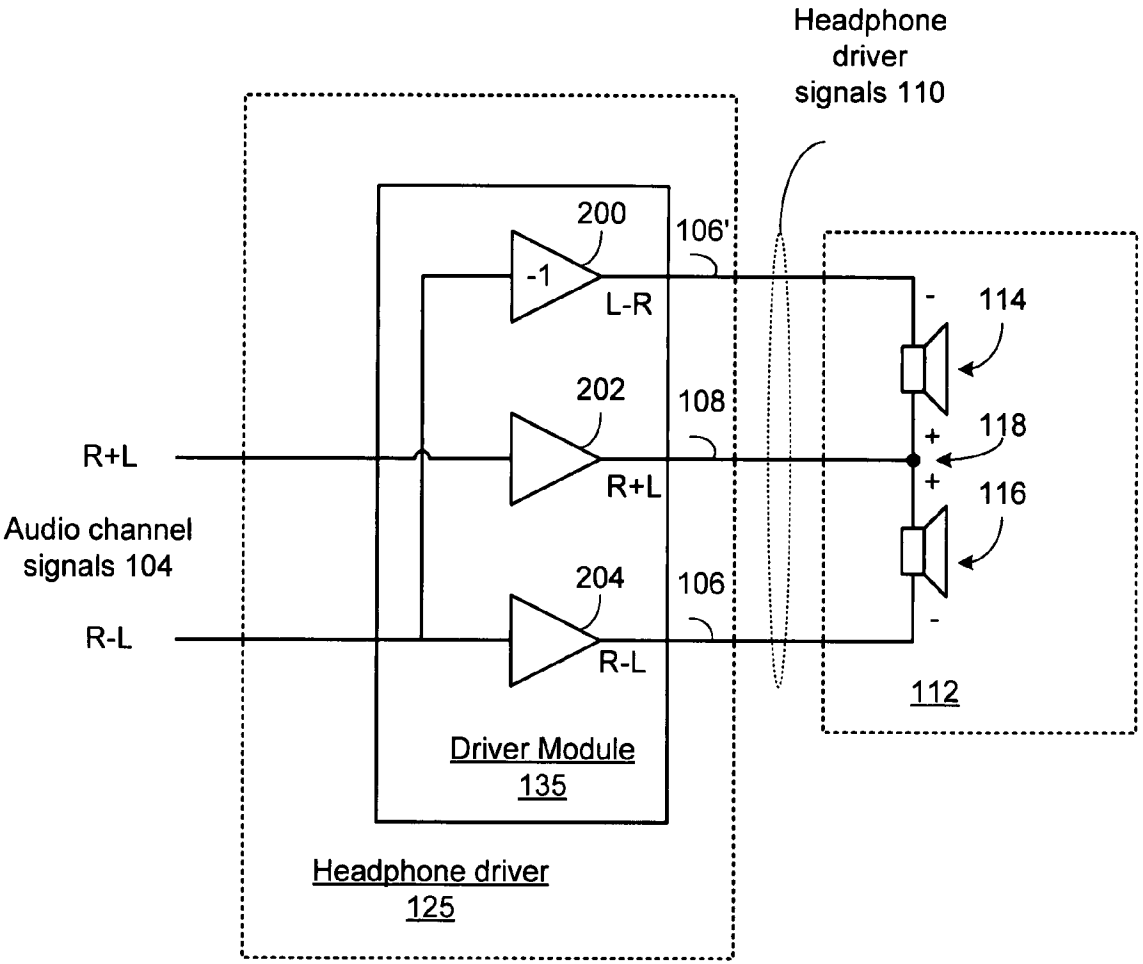
FIG. 3 presents a schematic block diagram of a headphone driver in accordance with an embodiment of the present invention.

FIG. 3 presents a schematic block diagram of a headphone driver in accordance with an embodiment of the present invention. In particular, an embodiment of headphone driver 125 and driver module 135 are presented. Headphones 112 are stereo headphones that include a right headphone element 114 and a left headphone element 116 that are coupled together at a common terminal 118. Driver module 135 includes an audio driver 202 for driving the stereo sum signal 108 on common terminal 118. Driver module 135 also includes an audio driver 200 for driving stereo difference signal 106' on the negative terminal of right headphone element 114. Driver module 135 further includes an audio driver 204 for driving stereo difference signal 106 on the negative terminal of left headphone element 116.

In an embodiment of the present invention, headphone driver signals 110 are direct current (DC) coupled to headphones 112. This avoids the necessity of providing capacitors for alternative current (AC) coupling of headphone drivers signals 110 to headphones 112 that would require substantial chip space or the use of external components when headphone driver 125 is implemented on an integrated circuit.

In an embodiment of the present invention, the right headphone element 114 and left headphone element 116 have relatively low load impedances, such as 100 Ohms or less. While headphones 112 are described as identified as "headphones" such as headphones 84, headphones 112 include earbuds, such as earbuds 82, and any other speakers or audio output devices that are capable of producing an audio output in response to headphone driver signals 110.

In an embodiment of the present invention, audio channel signals 104 are analog signals and audio drivers 200, 202, and 204 are audio power amplifiers that provide the power necessary drive the load impedances of headphones 112. Audio drivers 200, 202 and 204 optionally provide a voltage gain for amplifying the magnitude of audio channel signals 104. Further, audio driver 200 is an inverting amplifier that produces stereo difference signal 106' with a polarity that is inverted from the polarity of stereo difference signal 106. In an alternative embodiment of the present invention, audio channel signals 104 can be digital signals and headphone driver 125 or driver module 135 can include a plurality of digital to analog converter modules (not shown) for converting the digital audio channel signals 104 to corresponding analog audio channel signals.

In a stereo environment, driver module 135 can produce up to two times the maximum output swing of a typical driver module having a traditional right and left channel output. In operation, the voltage across right headphone element 114 can be represented by the voltage of stereo sum signal 108 (R+L) minus the voltage of stereo difference signal 106' (L−R), which equals (2R). Likewise, the voltage across left headphone element 116 can be represented by the voltage of stereo sum signal 108 (R+L) minus the voltage of stereo difference signal 106 (R−L), which equals (2L). This provides a maximum output voltage swing that is twice the swing of a traditional right and left channel driver configuration. In the alternative, the same maximum output voltage swing can be achieved with the audio drivers 200, 202 and 204 constructed with less voltage swing, when audio signals 104 have substantially independent right and left channel signals. A further advantage of this configuration is that it eliminates the need of radio stage 102 to include a stereo matrix circuit that produces right and left channel signals from the stereo sum and difference signals that result from demodulating an FM stereo broadcast.

Figure 4:
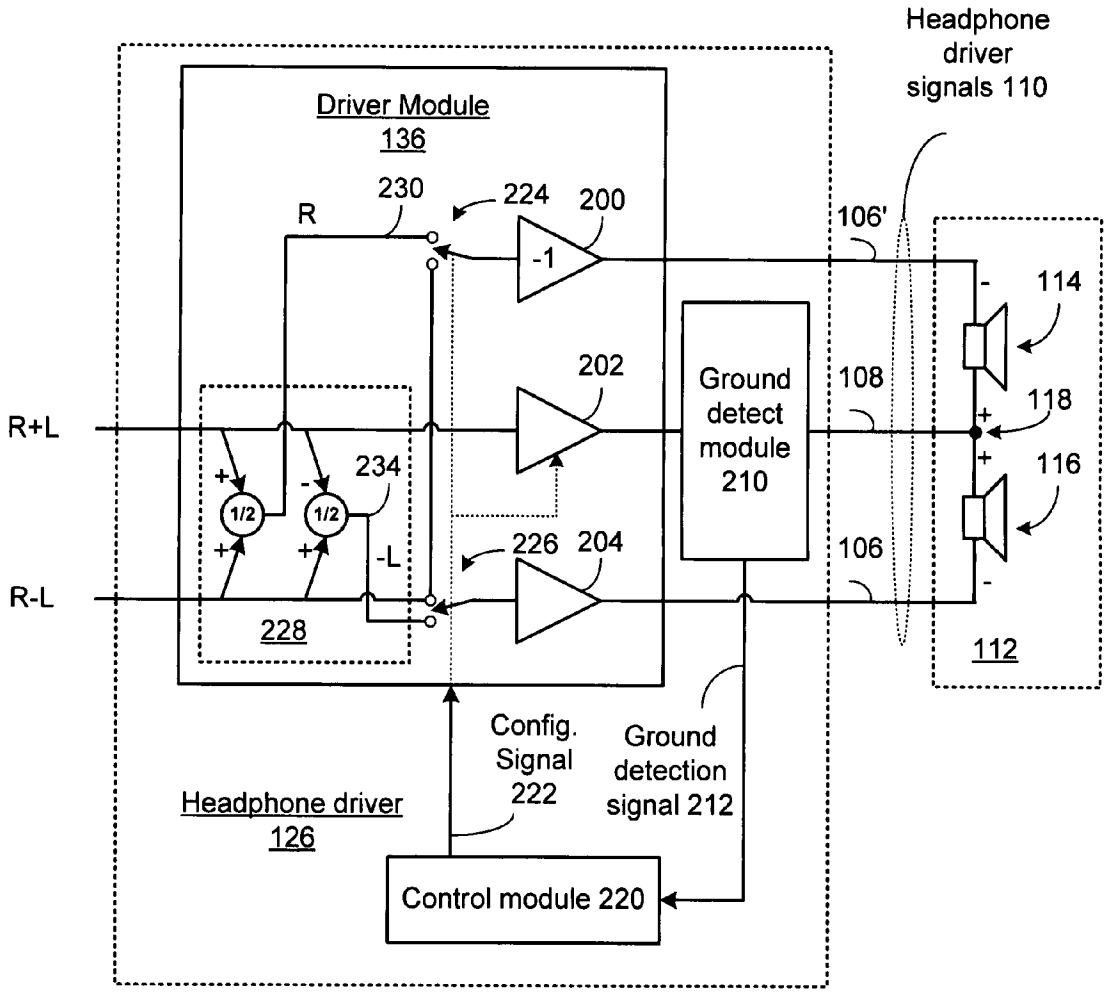
FIG. 4 presents a schematic block diagram of a headphone driver in accordance with an embodiment of the present invention.

FIG. 4 presents a schematic block diagram of a headphone driver in accordance with an alternative embodiment of the present invention. A headphone driver 126 is presented that can be used in implementations of radio receiver 50 in place of headphone driver 125. Headphone driver 126 includes many similar elements of headphone driver 125 that are referred to by common reference numerals. In addition, headphone driver 126 includes a ground detect module 210, operatively coupled to the common terminal 118 and audio driver 202, for asserting a ground detection signal 212 when headphones 112 are used that have common terminal 118 coupled to a ground voltage. Control module 220 is operatively coupled to the driver module 136 for disabling the audio driver 202 when the ground detection signal 212 is asserted. In a further embodiment, control module 220 is further operable to reconfigure the driver module 136 when the ground detection signal 212 is asserted, to have driver module 136 drive headphones 112 with a traditional right channel signal and left channel signal.

In an embodiment of the present invention, ground detect module 210 includes a jack sense module for detecting that headphones have been newly coupled to headphone driver 126. In response, ground detect module generates a test signal, such an oscillating signal, such as within, slightly above or below the audible frequency range. The ground detect module 212 monitors either the current drawn by common terminal 118 or the resulting voltage at common terminal 118 and compares the result to a voltage or current threshold, indicative of low impedance to ground. In response, ground detect module 210 asserts ground detection signal 212.

In a further embodiment of the present invention, ground detect module includes a current monitor and comparator for detecting a high current state on the output of audio driver 202 during operation. When the current draw from common terminal 118 exceeds a current threshold for a period that is sustained, beyond a time period corresponding to an acceptable level of clipping, ground detect module asserts ground detect signal 212. Alternatively, the current output of audio driver 202 can be limited and the voltage output can be compared to a threshold to detect a short to ground.

In an embodiment of the present invention, driver module 136 includes stereo decoder matrix 228 for producing right channel signal 230 and left channel signal 234. Switches 224 and 226, are controlled by configuration signal 222 from control module 220. When the ground detection signal 212 is deasserted, switches 224 and 226 couple audio channel signals 104 to audio drivers 200 and 204, and audio driver 202 is enabled. When configuration signal 222 is asserted in response to ground detection signal 212, switches 224 and 226 couple right channel signal 230 and left channel signal 234 to audio drivers 200 and 204 and audio driver 202 is disabled. In the embodiment shown where audio driver 200 is inverting, stereo decoder matrix 228 can generate an inverted right channel signal 230 as shown. In embodiments of the present invention, audio driver 202 can be disabled by being powered down, put into low current class A mode, being disconnected or by being otherwise disabled.

While configuration signal 222 is shown as a single signal, likewise separate signals can be generated to control the reconfiguration of driver module 136. In an embodiment of the present invention, control module 220 is implemented using a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions. The memory may be a single memory device or a plurality of memory devices. Such a memory device may be a read-only memory, random access memory, volatile memory, non-volatile memory, static memory, dynamic memory, flash memory, cache memory, and/or any device that stores digital information. Note that when the control module 220 implements one or more of its functions via a state machine, analog circuitry, digital circuitry, and/or logic circuitry, the memory storing the corresponding operational instructions may be embedded within, or external to, the circuitry comprising the state machine, analog circuitry, digital circuitry, and/or logic circuitry. Further the processing device or processing devices that implement the functions of control module 220 may optionally perform functions associated with ground detect module 210, driver module 136 and or other modules of the electronic device that optionally hosts headphone driver 126.

Figure 5:
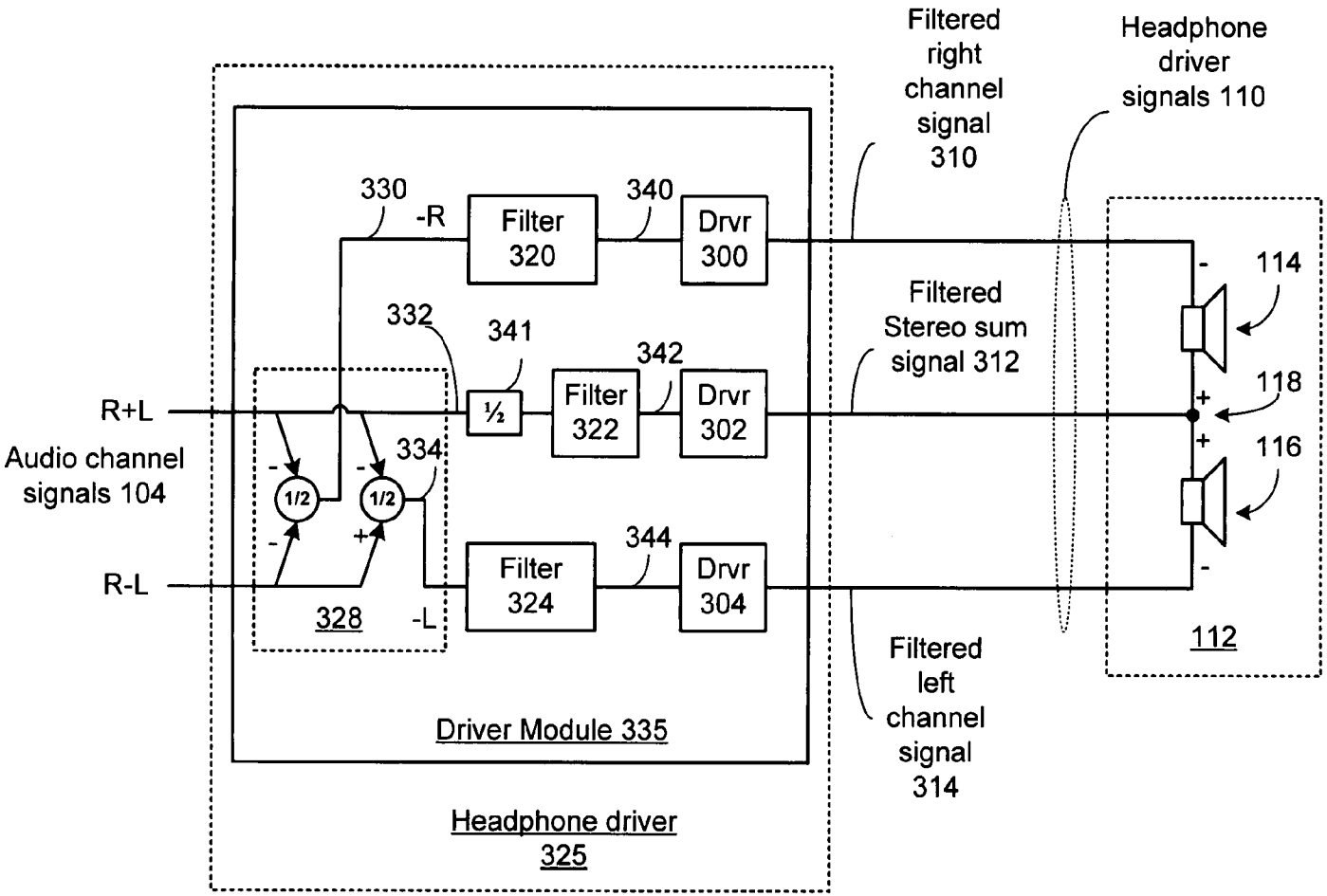
FIG. 5 presents a schematic block diagram of a headphone driver in accordance with an embodiment of the present invention.

FIG. 5 presents a schematic block diagram of a headphone driver in accordance with an alternative embodiment of the present invention. A headphone driver 325 is presented that can be used in implementations of radio receiver 50 in place of headphone driver 125 and/or 126. Headphone driver 325 includes many similar elements of headphone drivers 125 and 126 that are referred to by common reference numerals. A headphone driver 325 is presented that includes driver module 335 for generating a plurality of headphone driver signals 110 including a filtered stereo sum signal 312. In an embodiment of the present invention, driver module 335 DC couples the plurality of headphone driver signals 110 to headphones 112.

In an embodiment of the present invention, driver module 335 includes a stereo matrix decoder 328 that generates an inverted right channel signal 330 and an inverted left channel signal 334 from audio channel signals 104. Filter 322 filters stereo sum signal 332, attenuated by 6 dB (a gain of ½) by attenuator 341, into a filtered sum signal 342 that is input to driver 302. Driver 302 generates filtered stereo sum signal 312 on common terminal 118. Filter 320, filters right channel signal 330 into a filtered right channel signal 340 that is input to driver 300. Driver 300 generates filtered right channel signal 310 on a terminal that is coupled to a right headphone element 114. Filter 324, filters left channel signal 334 into a filtered left channel signal 344 that is input to driver 304. Driver 304 generates filtered left channel signal 314 on a terminal that is coupled to a left headphone element 116.

Figure 6:
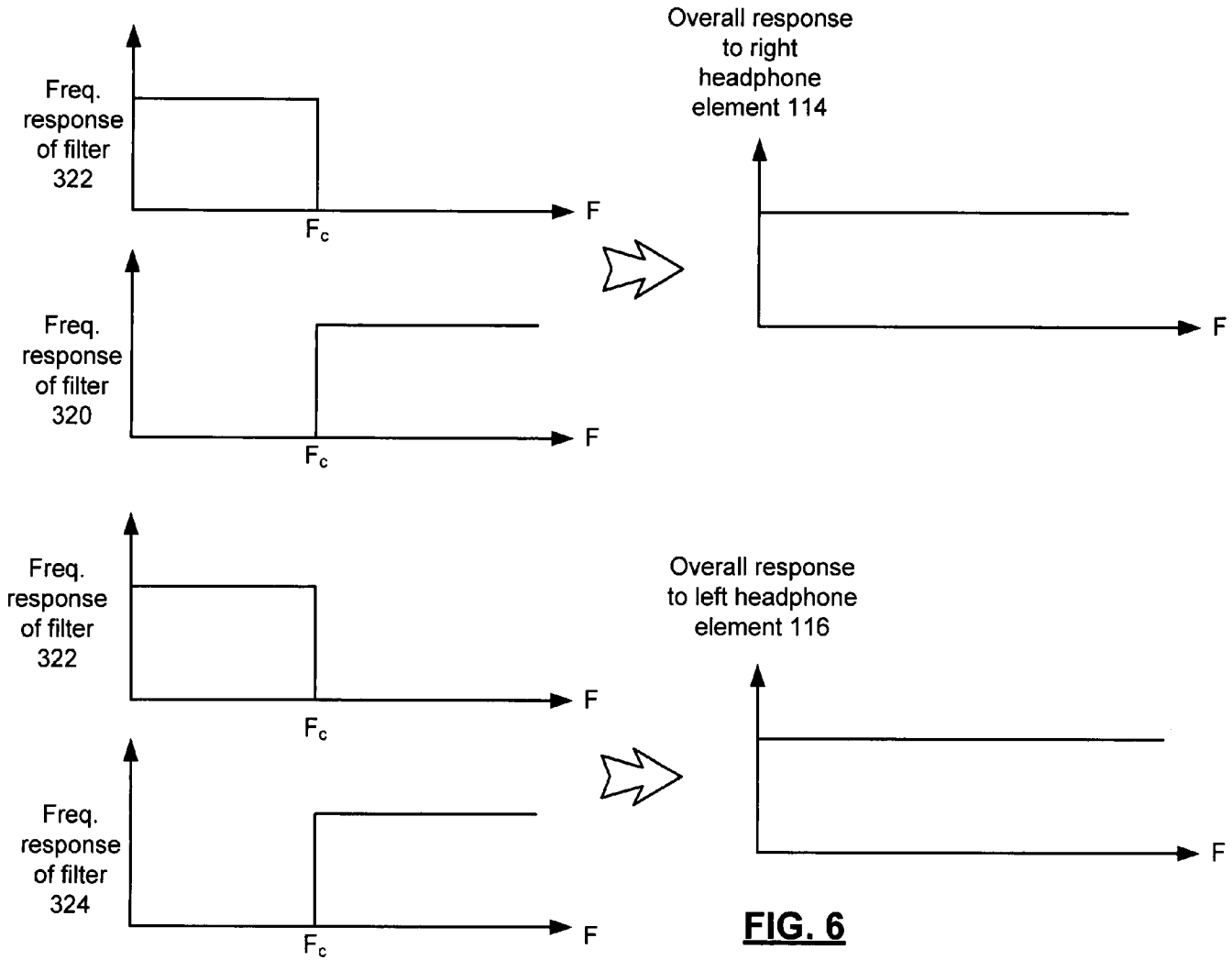
FIG. 6 presents a graphical representation of plurality of frequency responses in accordance with an embodiment of the present invention.

FIG. 6 presents a graphical representation of plurality of frequency responses in accordance with an embodiment of the present invention. In an embodiment of the present invention, filter 322 includes a low-pass filter having a corner frequency $F_c$. Filter 322 passes the low frequencies, such as the bass portion, of stereo sum signal 332 while attenuating higher frequency components. Filters 320 and 324 are high pass filters with corner frequency $F_c$. Right headphone element 114 is driven by a voltage potential that is equal to the filtered stereo sum signal 312 minus the filtered right channel signal 310. At low frequencies, the stereo separation is typically minimal, and the left channel signal is approximately equal to the right channel signal. In this case, the filtered stereo sum signal 312 is approximately equal to a low-pass filtered version of right channel signal 330. The voltage potential across right headphone 114 is then the sum of high-pass filtered and low-pass filtered versions of the right channel signal with approximately equal amplitudes. The overall frequency response to the right headphone element includes the high frequencies from filter 320 and the low frequencies from filter 322—forming a full spectrum. Likewise, the overall frequency response to the left headphone element includes the high frequencies from filter 324 and the low frequencies from filter 322—also forming a full spectrum.

While the frequency responses shown represent ideal filters, other filters may be implemented. In an embodiment of the present invention, filter 322 is a first order low-pass filter having a corner frequency $F_c$ and filters 320 and 324 are both first order high-pass filters and higher orders having corner frequency $F_c$. However, other filters including other high-pass and low-pass filters such as raised cosine filters, Butterworth filters, either digital or analog, etc., can be implemented within the broad scope of the present invention.

Figure 7:
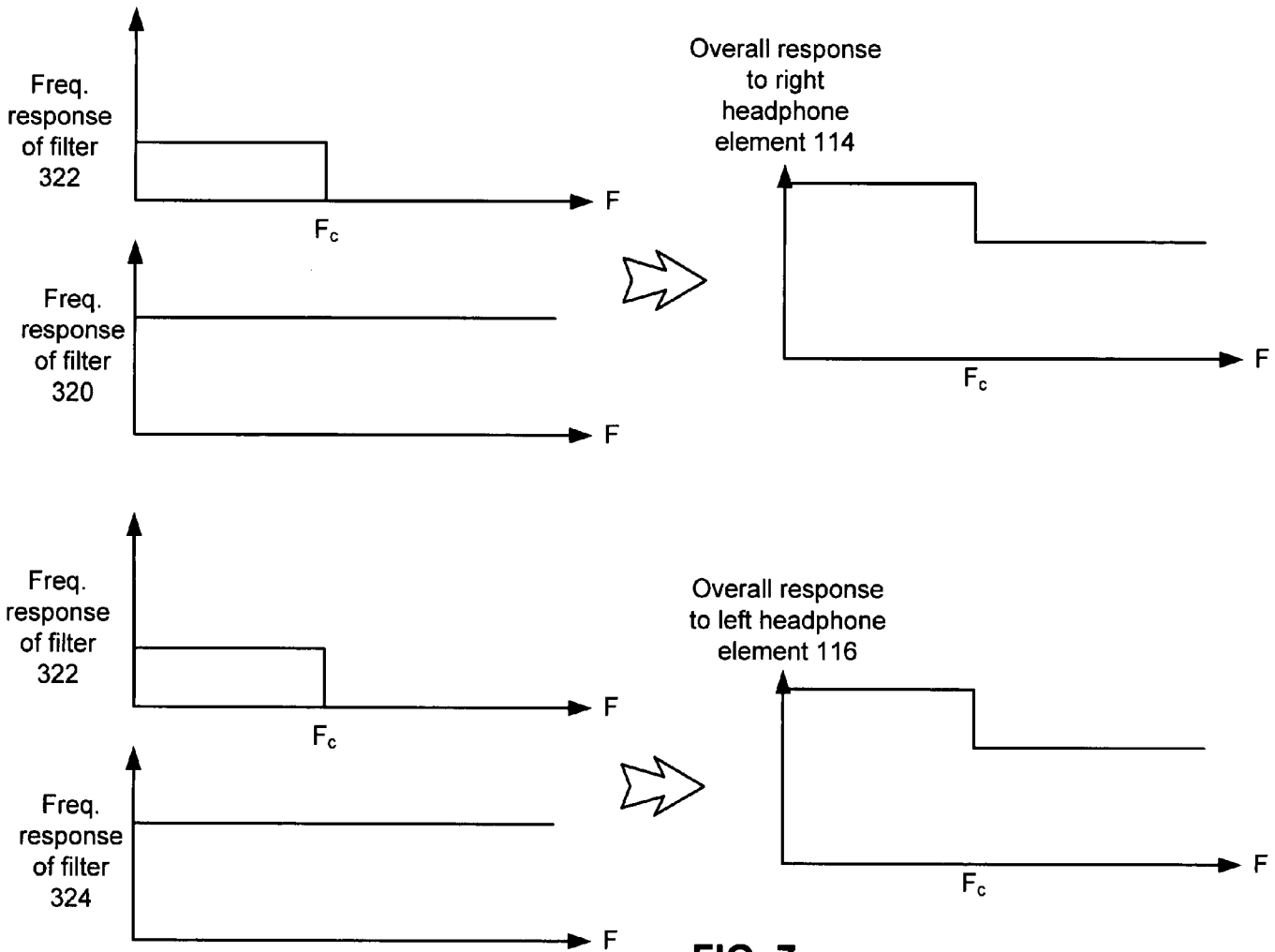
FIG. 7 presents a graphical representation of plurality of frequency responses in accordance with an embodiment of the present invention.

FIG. 7 presents a graphical representation of plurality of frequency responses in accordance with an embodiment of the present invention. While FIG. 6 illustrates flat spectrum frequency response characteristics as described above, other configurations are likewise possible. For instance, using a low-pass filter for filter 322 and all-pass filters for filters 320 and 324 results in a bass boost to right and left headphone elements 114 and 116. In an embodiment of the present invention, the gain of low-pass filter 322 is adjustable, providing an adjustable bass boost for equalization, user bass control functions and other applications. Other configurations can be used to attenuate the bass, boost the treble portions of the audio spectrum, provide loudness controls, and/or implement Fletcher-Munson equal-loudness contours, etcetera, within the broad scope of the present invention.

Figure 8:
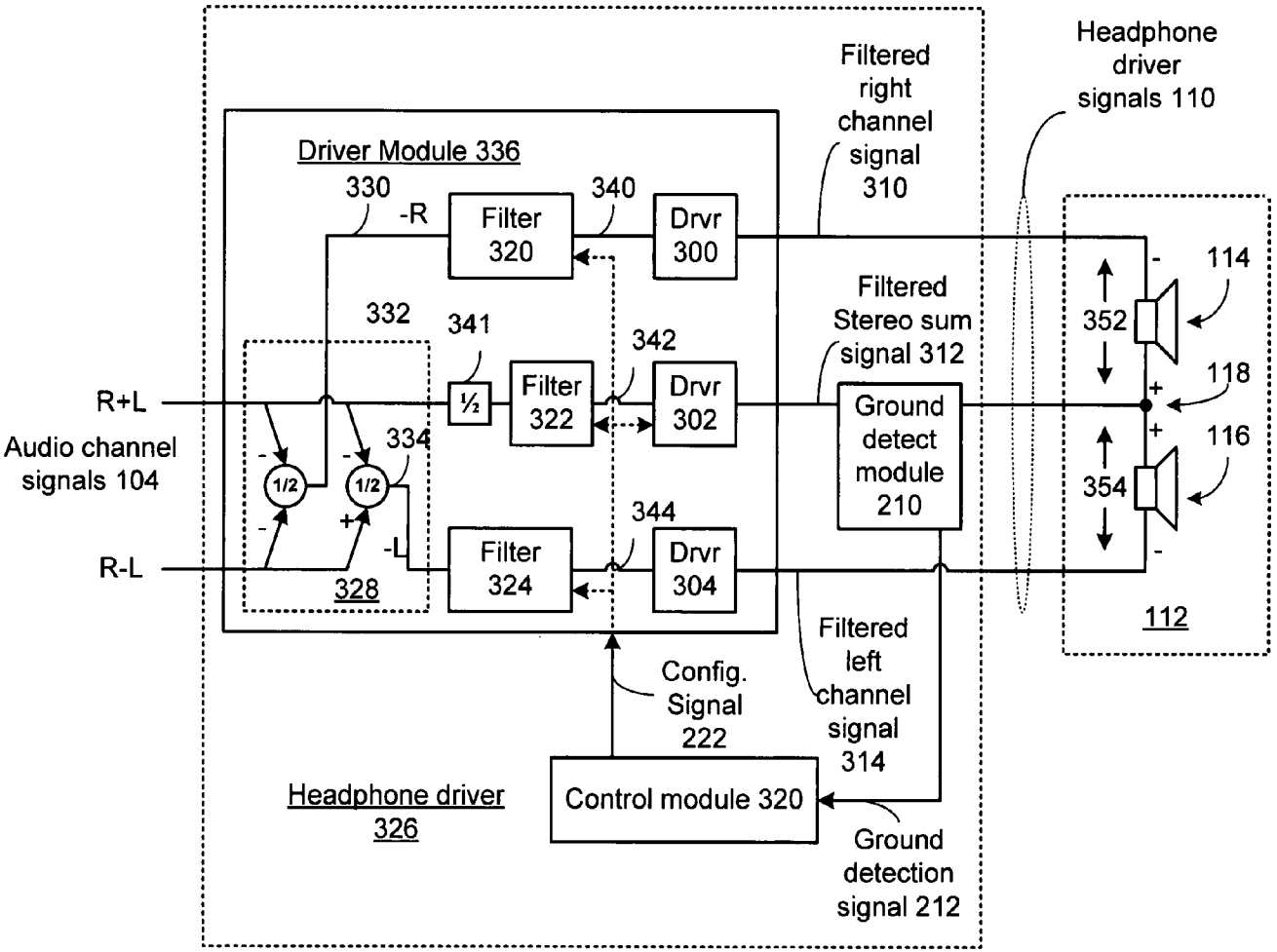
FIG. 8 presents a schematic block diagram of a headphone driver in accordance with an embodiment of the present invention.

FIG. 8 presents a schematic block diagram of a headphone driver in accordance with an alternative embodiment of the present invention. A headphone driver 326 is presented that can be used in implementations of radio receiver 50 in place of headphone drivers 125, 126, and 325. Headphone driver 326 includes many similar elements of headphone driver 125, 126 and 325 that are referred to by common reference numerals. In particular, headphone driver 326 includes ground detect module 210, operatively coupled to the common terminal 118 and driver 302, for asserting a ground detection signal 212 when headphones 112 are used that have common terminal 118 coupled to a ground voltage. Control module 320 is operatively coupled to the driver module 136 for disabling the driver 302 and filter 322 when the ground detection signal 212 is asserted. In a further embodiment, control module 320 is further operable to reconfigure the driver module 336 when the ground detection signal 212 is asserted, to have driver module 336 drive headphones 112 with a traditional right channel signal and left channel signal.

In an embodiment of the present invention, control module 320 is implemented in a manner similar to control module 220. However, in response to ground detection signal 212 being asserted, control module 320 generates configuration signal 222 that disables filter 322 and/or driver 302, and that converts filters 320 and 324 into all-pass filters—to the extent that filters 320 and 324 were implemented using other transfer functions. When ground detection signal 212 is asserted, driver 300 produces filtered right channel signal 310 directly from right channel signal 330. In this mode, filtered right channel signal 310 is all-pass filtered. Further, when ground detection signal 212 is asserted, driver 304 produces filtered left channel signal 314 directly from left channel signal 334. In this mode, filtered left channel signal 314 is all-pass filtered. It should be noted that any of the all-pass filters disclosed herein can be implemented by disabling or bypass a filter with an alternative transfer function, since an all-pass filter does not alter the frequency characteristics of an input signal.

Figure 9:
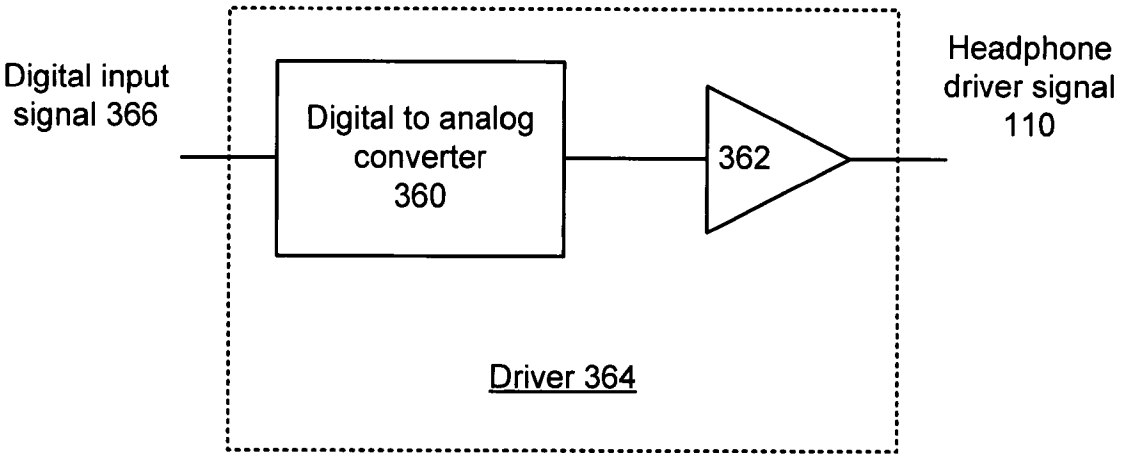
FIG. 9 presents a schematic block diagram of a driver in accordance with an embodiment of the present invention.

FIG. 9 presents a schematic block diagram of a driver in accordance with an embodiment of the present invention. Driver 364 is shown that can be used to implement drivers 300, 302 and/or 304 presented in association with FIGS. 5 and 8. In particular, driver 364 uses digital to analog converter (DAC) 360 to convert a digital input 366 to an analog input of audio driver 362. In an embodiment of the present invention, audio driver 362 can be implemented in a similar fashion to audio drivers 200, 202 and 204. Driver 362 can be either a single-ended driver or a differential driver.

Figure 10:
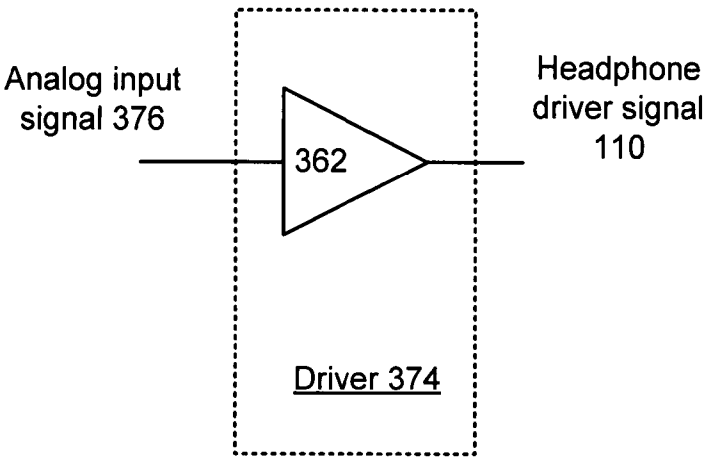
FIG. 10 presents a schematic block diagram of a driver in accordance with an embodiment of the present invention.

FIG. 10 presents a schematic block diagram of a driver in accordance with an alternative embodiment of the present invention. Driver 374 is shown that can be used to implement drivers 300, 302 and/or 304 presented in association with FIGS. 5 and 8. In particular, audio driver 362 accepts an analog input signal 376 and can be implemented in a similar fashion to audio drivers 200, 202 and 204.

Figure 11:
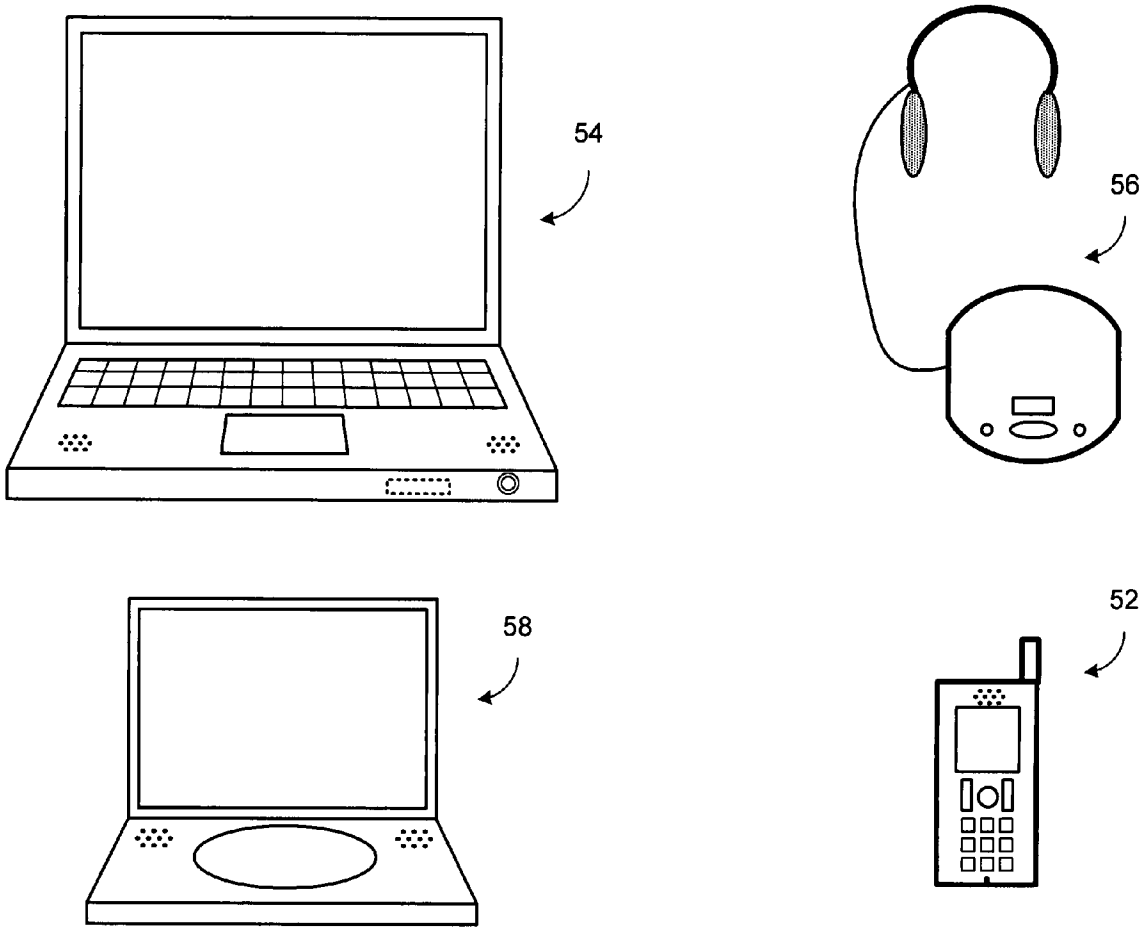
FIG. 11 presents pictorial representations of various electronic devices in accordance with embodiments of the present invention.

FIG. 11 presents pictorial representations of various electronic devices in accordance with embodiments of the present invention. While the prior description has focused on a headphone drivers 125, 126, 325 and 326 that are implemented in a radio receiver, such as radio receiver 50, similar drivers may be implemented on a wide variety of other electronic devices such as computer 54, CD player 56, DVD player 58, wireless telephone 52, and other devices that employ headphones, earbuds or other audio output devices with two or more channels.

Figure 12:
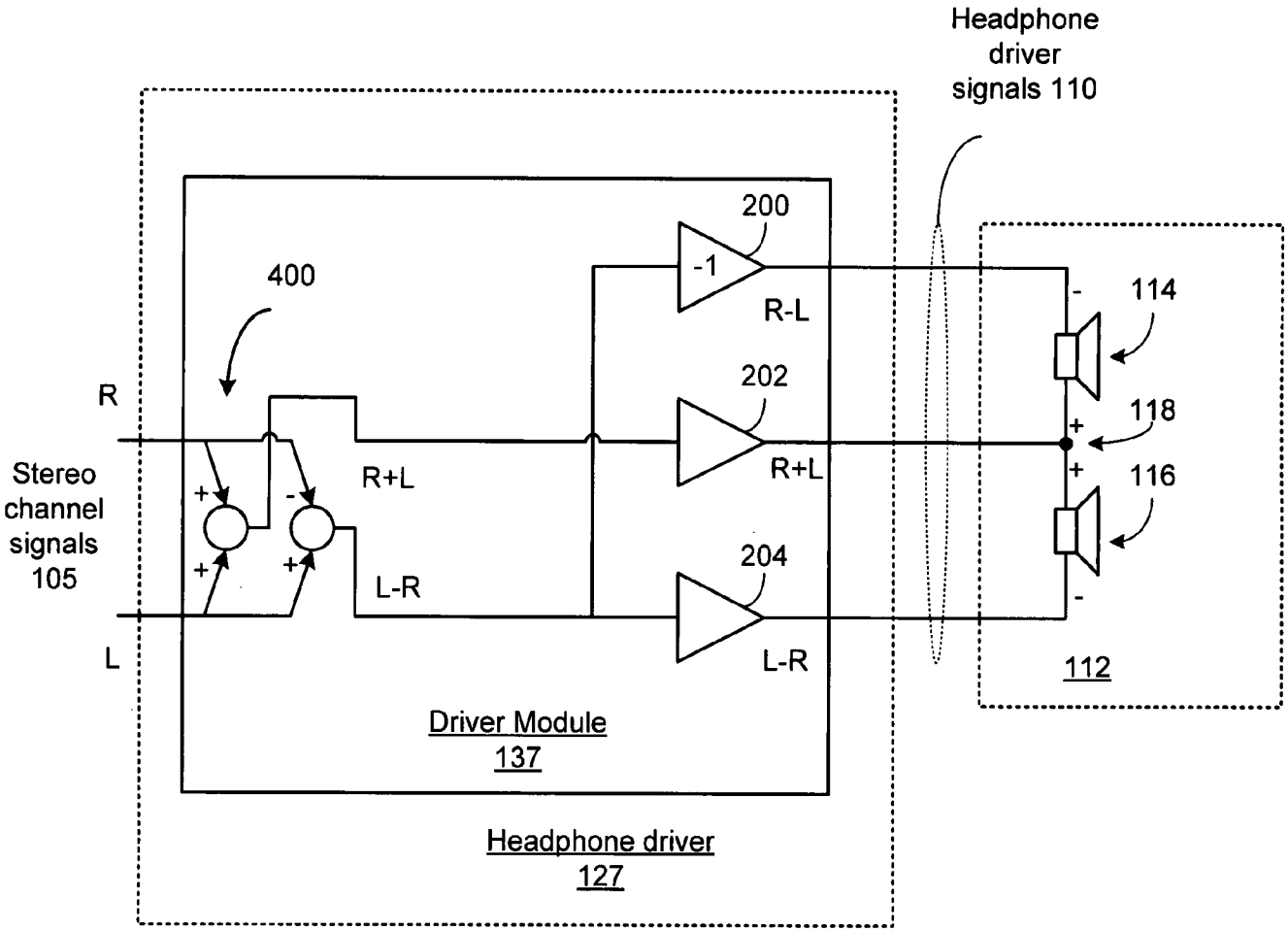
FIG. 12 presents a schematic block diagram of a headphone driver in accordance with an embodiment of the present invention.

FIG. 12 presents a schematic block diagram of a headphone driver in accordance with an embodiment of the present invention. A headphone driver 127 is presented that can be used in implementations of radio receiver 50, computer 54, CD player 56, DVD player 58, wireless telephone 52 in place of headphone driver 125. In particular, headphone driver 127 includes similar elements to headphone driver 125 referred to by common reference numerals. However, headphone driver 127 receives stereo channel signals 105 that include traditional right and left channel signals. Driver module 137 includes stereo matrix encoder 400 for producing the stereo sum and difference signals that are employed.

Figure 13:
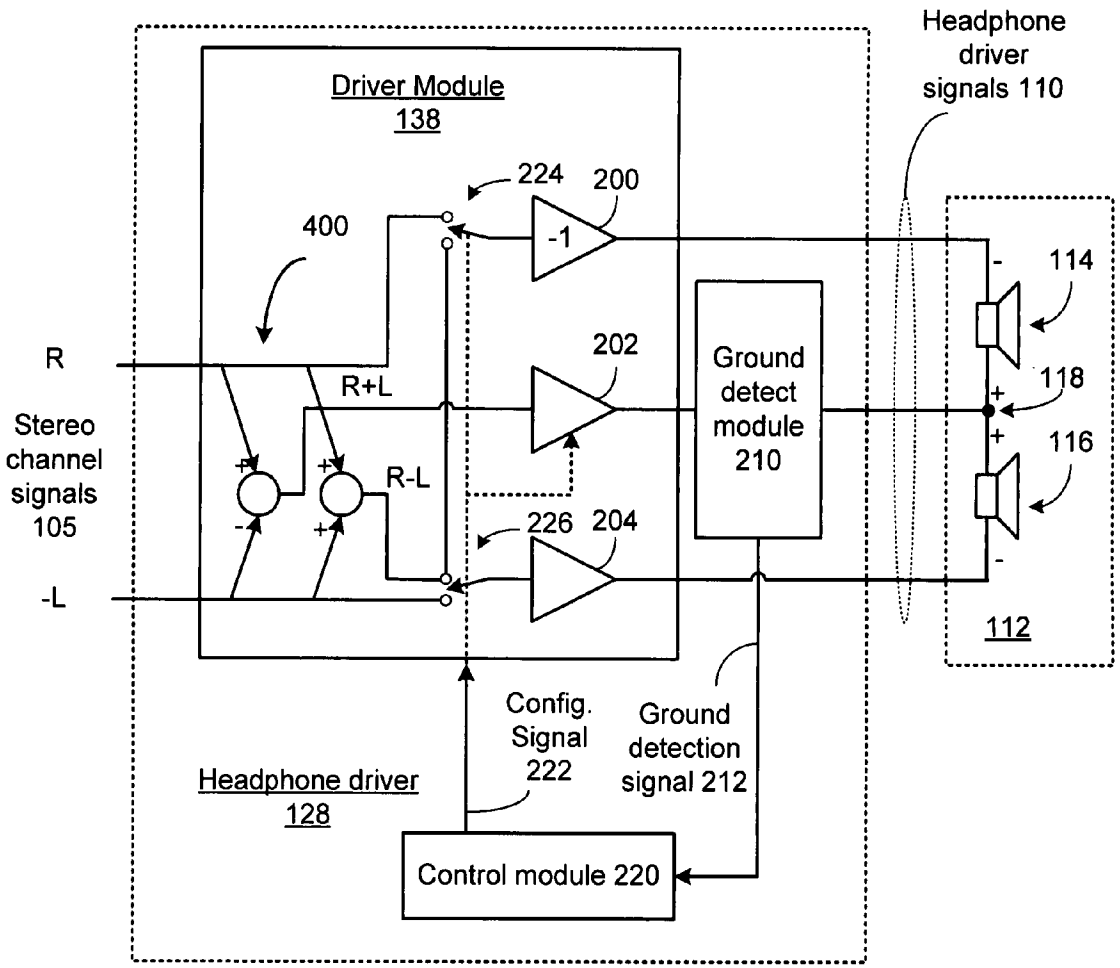
FIG. 13 presents a schematic block diagram of a headphone driver in accordance with an embodiment of the present invention.

FIG. 13 presents a schematic block diagram of a headphone driver in accordance with an embodiment of the present invention. A headphone driver 128 is presented that can be used in implementations of radio receiver 50, computer 54, CD player 56, DVD player 58, wireless telephone 52 in place of headphone driver 126. In particular, headphone driver 128 includes similar elements to headphone driver 126 referred to by common reference numerals. However, headphone driver 128 receives stereo channel signals 105 that include traditional right and left channel signals. Driver module 138 includes stereo matrix encoder 400 for producing the stereo sum and difference signals that are employed.

Figure 14:
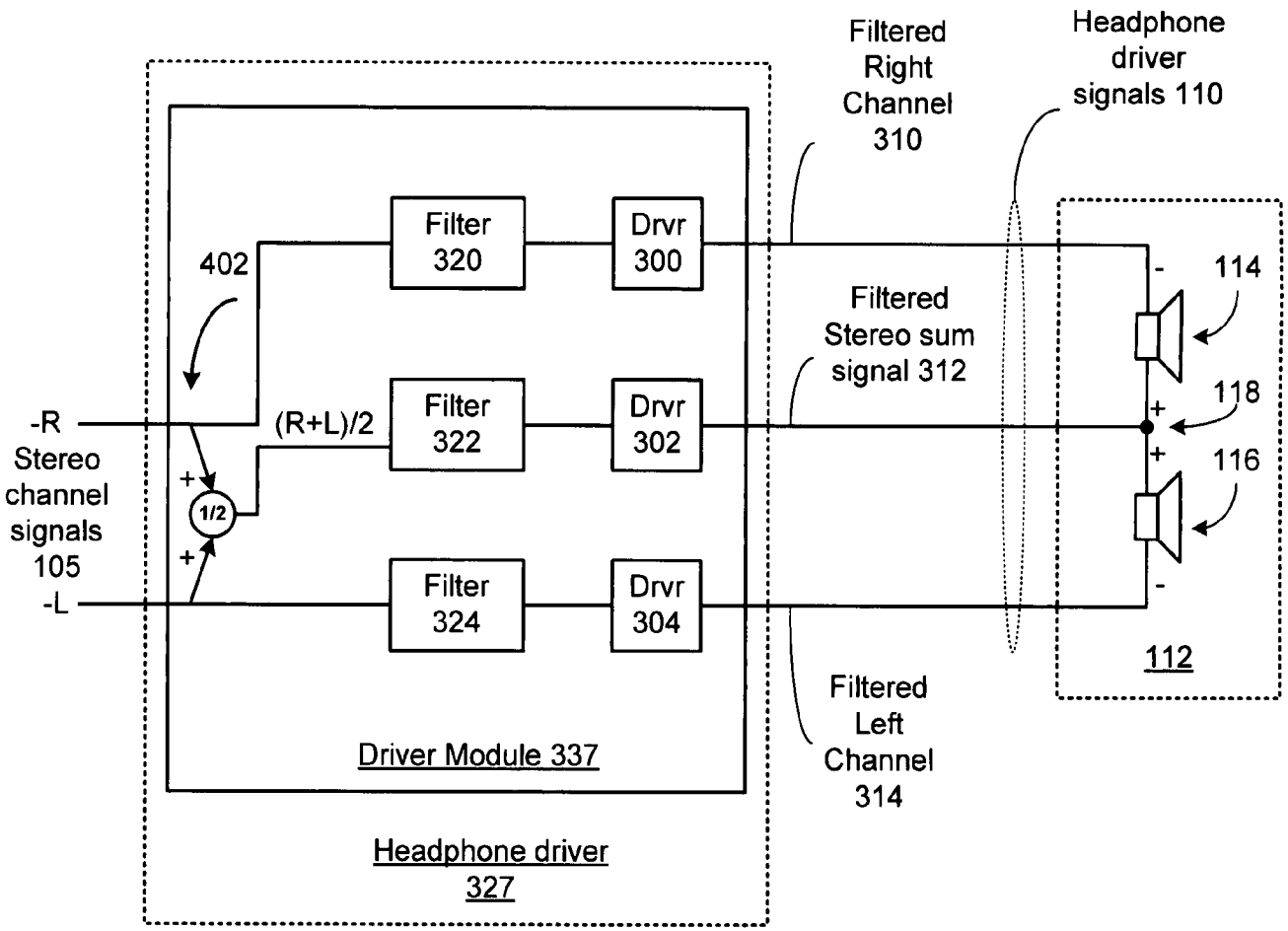
FIG. 14 presents a schematic block diagram of a headphone driver in accordance with an embodiment of the present invention.

FIG. 14 presents a schematic block diagram of a headphone driver in accordance with an embodiment of the present invention. A headphone driver 327 is presented that can be used in implementations of radio receiver 50, computer 54, CD player 56, DVD player 58, wireless telephone 52 in place of headphone driver 325. In particular, headphone driver 327 includes similar elements to headphone driver 325 referred to by common reference numerals. However, headphone driver 327 receives stereo channel signals 105 that include traditional right and left channel signals. Driver module 337 includes summing module 402 for producing the stereo sum signal that is employed.

Figure 15:
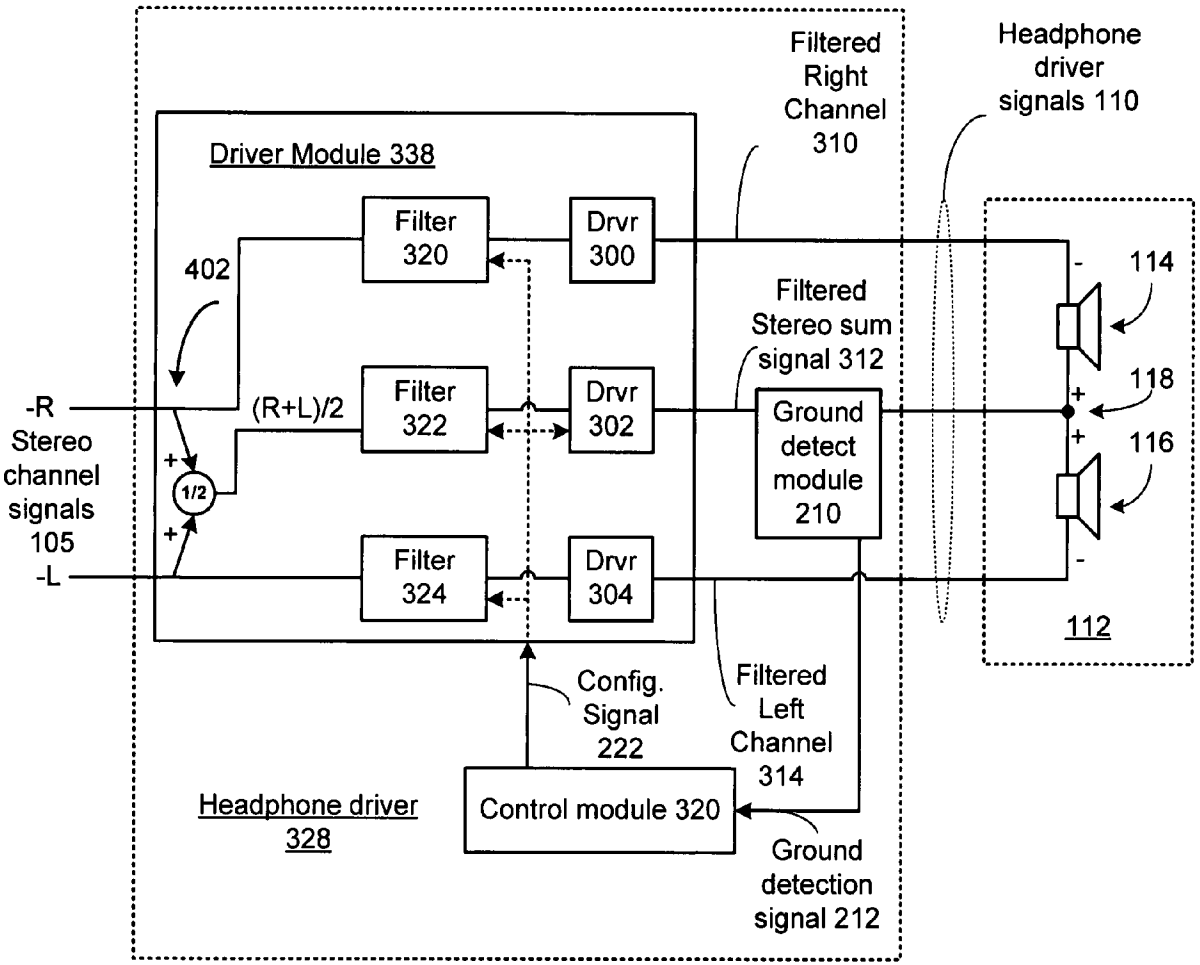
FIG. 15 presents a schematic block diagram of a headphone driver in accordance with an embodiment of the present invention.

FIG. 15 presents a schematic block diagram of a headphone driver in accordance with an embodiment of the present invention. A headphone driver 328 is presented that can be used in implementations of radio receiver 50, computer 54, CD player 56, DVD player 58, wireless telephone 52 in place of headphone driver 326. In particular, headphone driver 328 includes similar elements to headphone driver 326 referred to by common reference numerals. However, headphone driver 328 receives stereo channel signals 105 that include traditional right and left channel signals. Driver module 338 includes summing module 402 for producing the stereo sum signal that is employed.

Figure 16:
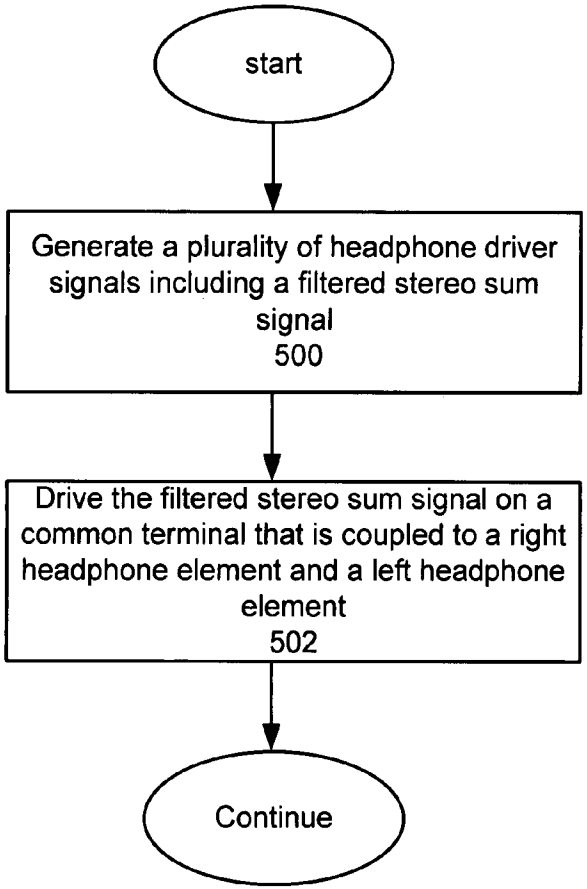
FIG. 16 presents a flowchart representation of a method in accordance with an embodiment of the present invention.

FIG. 16 presents a flowchart representation of a method in accordance with an embodiment of the present invention. In particular, a method is presented for use in conjunction with one or more of the features and functions presented in association with FIGS. 1-15. In step 500, a plurality of headphone driver signals are generated including a filtered stereo sum signal. In step 502, the filtered stereo sum signal is driven on a common terminal that is coupled to a right headphone element and a left headphone element. In an embodiment of the present invention, step 500 includes low-pass filtering a stereo sum signal.

In an embodiment of the present invention step 500 includes high-pass filtering a right channel signal, and step 502 includes driving the filtered right channel signal to a terminal that is coupled to a right headphone element. In an embodiment of the present invention step 500 includes high-pass filtering a left channel signal, and step 502 includes driving the filtered left channel signal to a terminal that is coupled to a left headphone element.

Figure 17:
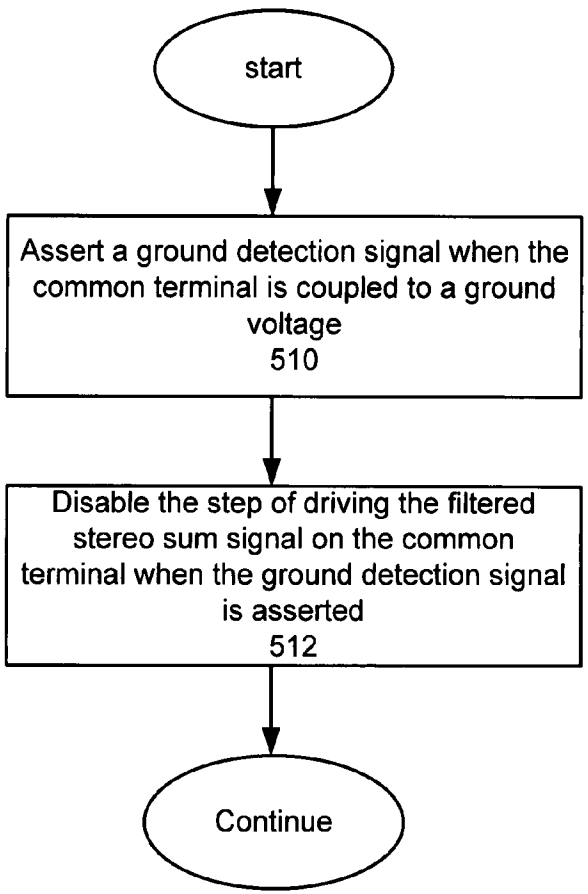
FIG. 17 presents a flowchart representation of a method in accordance with an embodiment of the present invention.

FIG. 17 presents a flowchart representation of a method in accordance with an embodiment of the present invention. In particular, a method is presented for use in conjunction with the method of FIG. 16. In step 510, a ground detection signal is asserted when the common terminal is coupled to a ground voltage. In step 512, step 502 is disabled when the ground detection signal is asserted. In an embodiment of the present invention, step 500 includes generating a right channel signal and a left channel signal when the ground detection signal is asserted.

Figure 18:
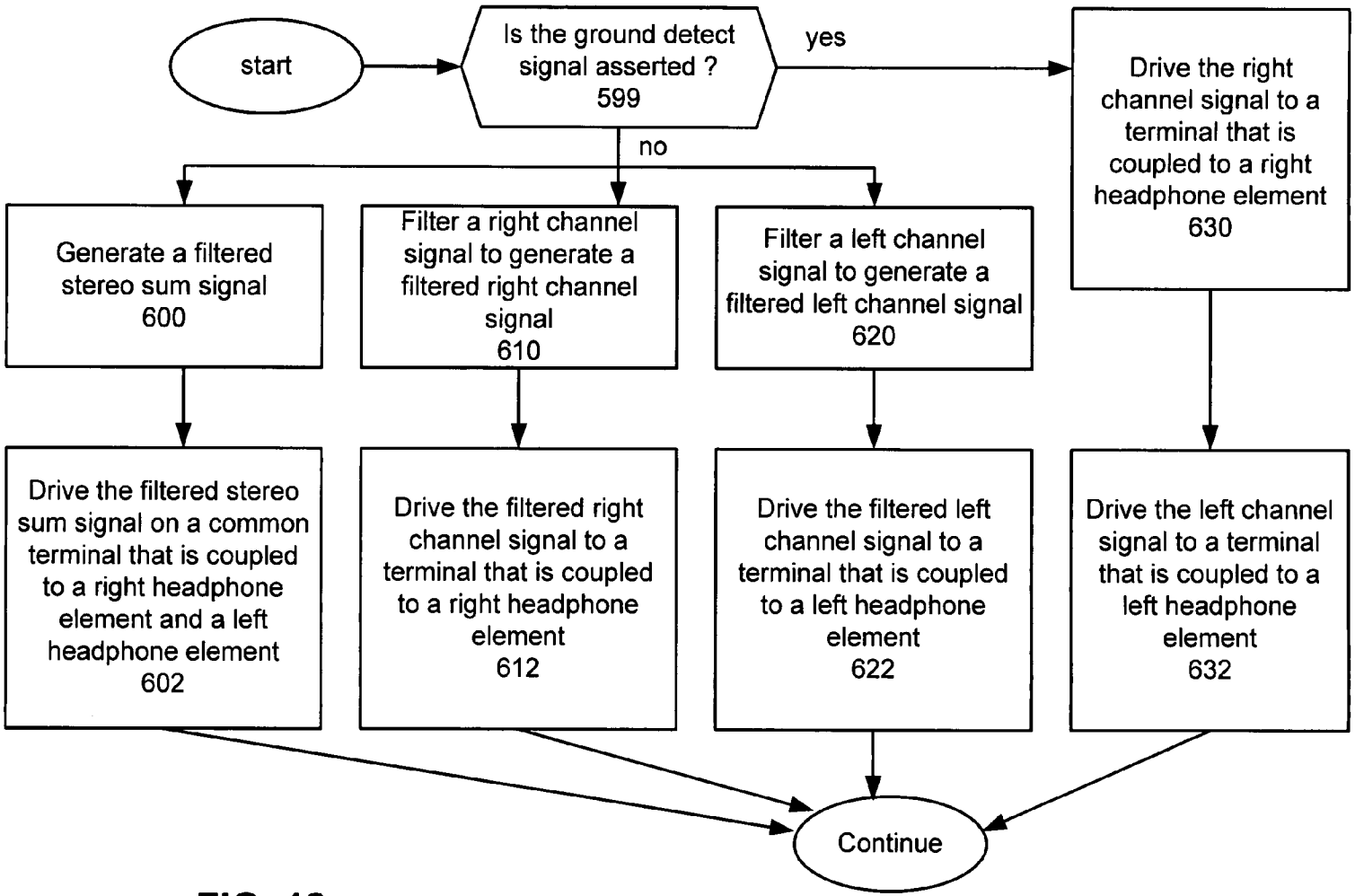
FIG. 18 presents a flowchart representation of a method in accordance with an embodiment of the present invention.

FIG. 18 presents a flowchart representation of a method in accordance with an embodiment of the present invention. In particular, a method is presented for use in conjunction with one or more of the features and functions presented in association with FIGS. 1-17. In step 599, the method determines if a ground detect signal is asserted. If so, the method executes steps 630 and 632, and if not, the method executes steps 600, 602, 610, 612, 620 and 622.

In step 630 a right channel signal is driven to a terminal that is coupled to a right headphone element. In step 632 a left channel signal is driven to a terminal that is coupled to a left headphone element.

In step 600, a filtered stereo sum signal is generated. In step 602, the filtered stereo sum signal is driven on a common terminal that is coupled to a right headphone element and a left headphone element. In an embodiment of the present invention, step 600 includes low-pass filtering a stereo sum signal.

In step 610 a right channel signal is filtered. In step 612, the filtered right channel signal is driven to a terminal that is coupled to a right headphone element. In step 620 a left channel signal is filtered. In step 622, the filtered left channel signal is driven to a terminal that is coupled to a left headphone element. The filtering of the right and left channel signal can be high-pass filtering, low-pass filtering or filtering with other transfer functions.

Figure 19:
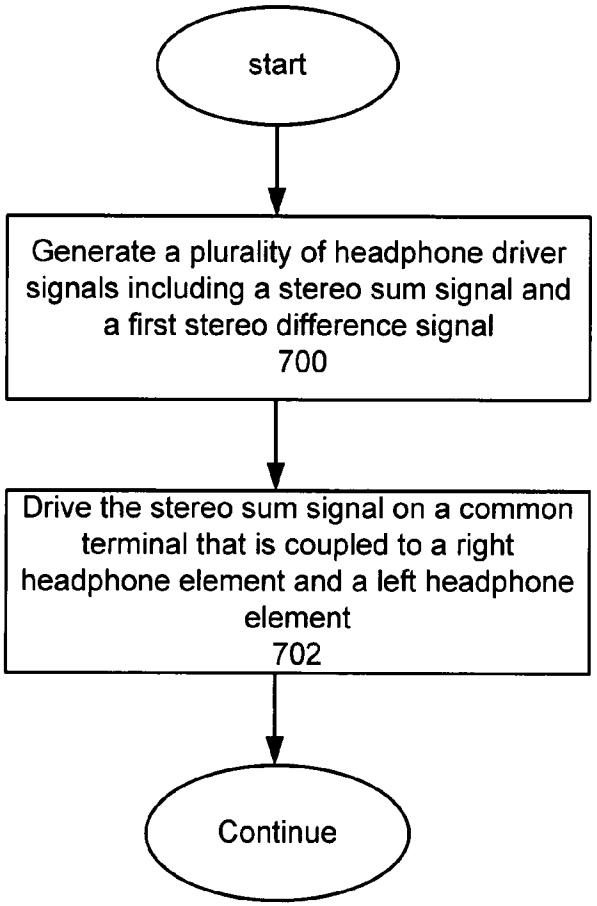
FIG. 19 presents a flowchart representation of a method in accordance with an embodiment of the present invention.

FIG. 19 presents a flowchart representation of a method in accordance with an embodiment of the present invention. In particular, a method is presented for use in conjunction with one or more of the features and functions presented in association with FIGS. 1-15. In step 700, a plurality of headphone driver signals are generated including a stereo sum signal and a first stereo difference signal. In step 702, the stereo sum signal is driven on a common terminal that is coupled to a right headphone element and a left headphone element.

Figure 20:
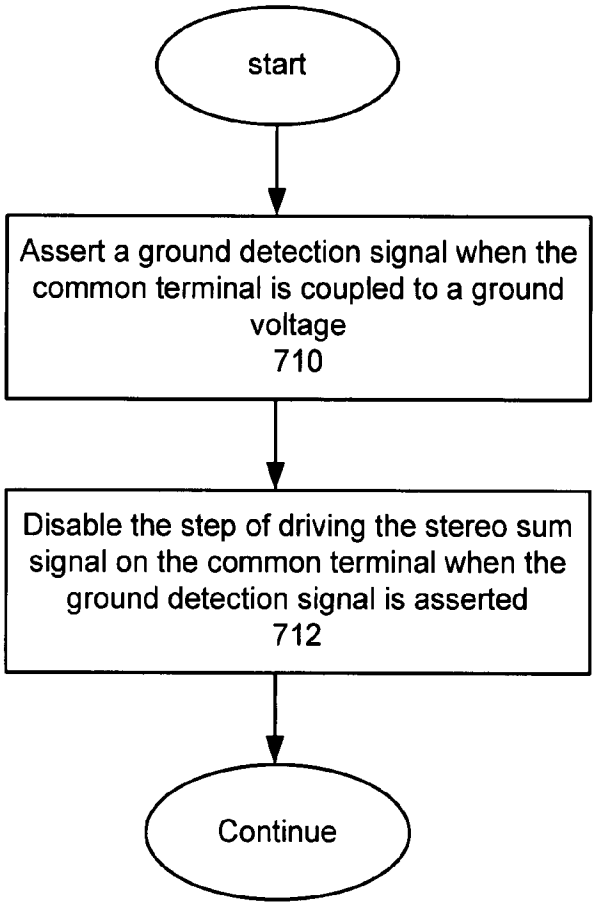
FIG. 20 presents a flowchart representation of a method in accordance with an embodiment of the present invention.

FIG. 20 presents a flowchart representation of a method in accordance with an embodiment of the present invention. In particular, a method is presented for use in conjunction with one or more of the features and functions presented in association with FIG. 19. In step 710, a ground detection signal is asserted when the common terminal is coupled to a ground voltage. In step 712, step 702 is disabled when the ground detection signal is asserted. In an embodiment of the present invention, step 700 includes generating a right channel signal and a left channel signal when the ground detection signal is asserted.

Figure 21:
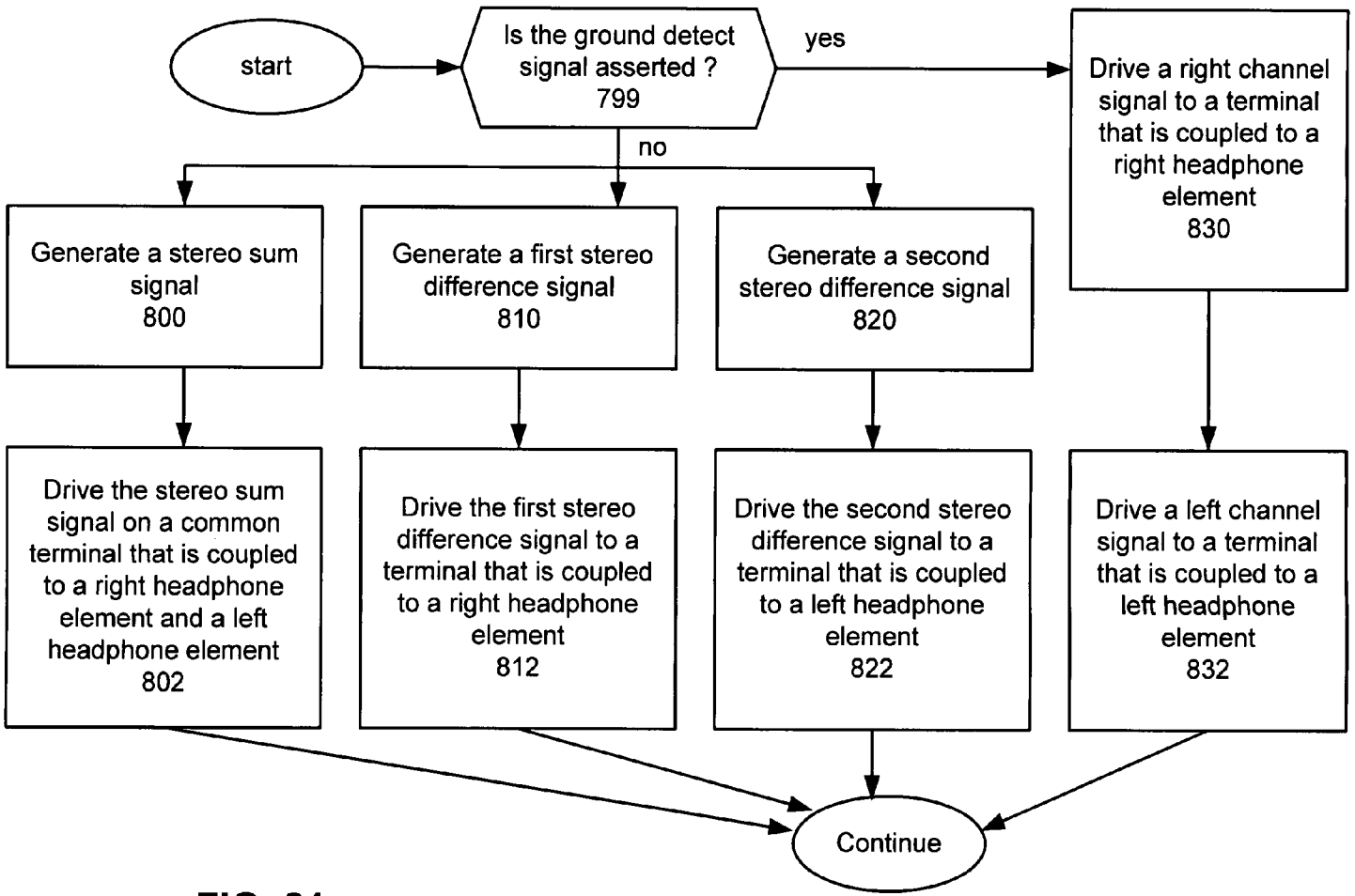
FIG. 21 presents a flowchart representation of a method in accordance with an embodiment of the present invention.

FIG. 21 presents a flowchart representation of a method in accordance with an embodiment of the present invention. In particular, a method is presented for use in conjunction with one or more of the features and functions presented in association with FIGS. 1-15. In step 799, the method determines if a ground detect signal is asserted. If so, the method executes steps 830 and 832, and if not, the method executes steps 800, 802, 810, 812, 820 and 822.

In step 830 a right channel signal is driven to a terminal that is coupled to a right headphone element. In step 832 a left channel signal is driven to a terminal that is coupled to a left headphone element.

In step 800, a stereo sum signal is generated. In step 802, the stereo sum signal is driven on a common terminal that is coupled to a right headphone element and a left headphone element.

In step 810 a first stereo difference signal is generated. In step 812, the first stereo difference signal is driven to a terminal that is coupled to a right headphone element. In step 820 a second stereo difference signal is generated. In step 812, the second stereo difference signal is driven to a terminal that is coupled to a left headphone element. In an embodiment of the present invention, the first stereo difference signal has a polarity that is inverted from a polarity of the second stereo difference signal.

Figure 22:
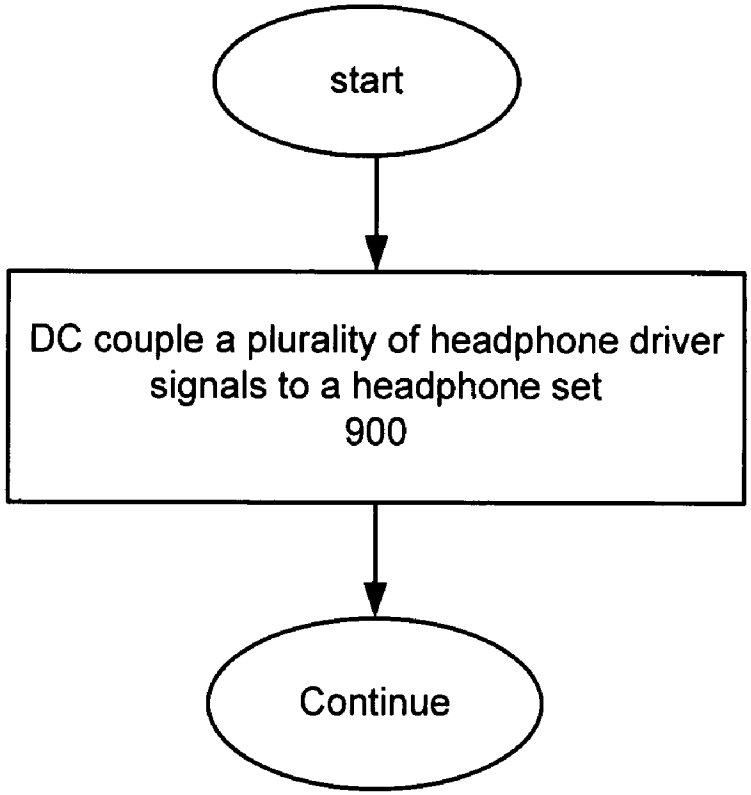
FIG. 22 presents a flowchart representation of a method in accordance with an embodiment of the present invention.

FIG. 22 presents a flowchart representation of a method in accordance with an embodiment of the present invention. In particular, a method is presented for use in conjunction with one or more of the features and functions presented in association with FIGS. 1-21. In step 900, the plurality of headphone driver signals are direct current (DC) coupled to a headphone set.

As one of ordinary skill in the art will appreciate, the term "substantially" or "approximately", as may be used herein, provides an industry-accepted tolerance to its corresponding term and/or relativity between items. Such an industry-accepted tolerance ranges from less than one percent to twenty percent and corresponds to, but is not limited to, component values, integrated circuit process variations, temperature variations, rise and fall times, and/or thermal noise. Such relativity between items ranges from a difference of a few percent to magnitude differences. As one of ordinary skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of ordinary skill in the art will also appreciate, inferred coupling (i.e., where one element is coupled to another element by inference) includes direct and indirect coupling between two elements in the same manner as "operably coupled". As one of ordinary skill in the art will further appreciate, the term "compares favorably", as may be used herein, indicates that a comparison between two or more elements, items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

In preferred embodiments, the various circuit components are implemented using 0.35 micron or smaller CMOS technology. Provided however that other circuit technologies, both integrated or non-integrated, may be used within the broad scope of the present invention. Likewise, various embodiments described herein can also be implemented as software programs running on a computer processor. It should also be noted that the software implementations of the present invention can be stored on a tangible storage medium such as a magnetic or optical disk, read-only memory or random access memory and also be produced as an article of manufacture.

Thus, there has been described herein an apparatus and method, as well as several embodiments including a preferred embodiment, for implementing a headphone driver, and driver module. Various embodiments of the present invention herein-described have features that distinguish the present invention from the prior art.

It will be apparent to those skilled in the art that the disclosed invention may be modified in numerous ways and may assume many embodiments other than the preferred forms specifically set out and described above. Accordingly, it is intended by the appended claims to cover all modifications of the invention which fall within the true spirit and scope of the invention.

What is claimed is:

1. A headphone driver module comprising:

a low-pass filter for providing a filtered stereo sum signal from a stereo sum signal, wherein the low-pass filter has a corner frequency that is within an audio range;

a first audio driver for driving the filtered stereo sum signal on a common terminal that is coupled to a right headphone element and a left headphone element;

a first high-pass filter for providing a filtered right channel signal from a right channel signal;

a second audio driver for driving the filtered right channel signal on a second terminal of the right headphone element;

a second high-pass filter for providing a filtered left channel signal from a left channel signal;

a third audio driver for driving the filtered left channel signal on a second terminal of the left headphone element;

a ground detect module, operatively coupled to the common terminal, for asserting a ground detection signal when the common terminal is coupled to a ground voltage; and a control module, operatively coupled to the first audio driver, for disabling the first audio driver when the ground detection signal is asserted, wherein the control module disables or bypasses filtering of the first high-pass filter when the ground detection signal is asserted so that the second audio driver drives the right channel signal on the second terminal of the right headphone element, and wherein the control module disables or bypasses filtering of the second high-pass filter when the ground detection signal is asserted so that the third audio driver drives the left channel signal on the second terminal of the left headphone element.

2. The headphone driver module of claim 1 wherein the first high-pass filter has a corner frequency that is within the audio range.

3. The headphone driver module of claim 1 wherein the second high-pass filter has a corner frequency that is within the audio range.

4. The headphone driver module of claim 1 wherein the first, second and third audio drivers provide direct current (DC) coupling to a headphone set.

5. A headphone driver comprising:

a decoder matrix having a first input receiving a stereo sum signal which comprises a sum of a right channel signal and a left channel signal, having a second input receiving a stereo difference signal which comprises a difference of the right channel signal and the left channel signal, having a first output providing the right channel signal and having a second output providing the left channel signal;

a first audio driver which drives the stereo sum signal on a common terminal when a ground detection signal is not asserted, wherein the common terminal is coupled to a first terminal of each of a right headphone element and a left headphone element;

a second audio driver which drives the stereo difference signal on a second terminal of the right headphone element when the ground detection signal is not asserted;

a third audio driver which drives the stereo difference signal on a second terminal of the left headphone element when the ground detection signal is not asserted;

a first switch which selectively provides one of the right channel signal and the stereo difference signal to the second audio driver, wherein the first switch selects the stereo difference signal when the ground detection signal is not asserted;

a second switch which selectively provides one of the left channel signal and the stereo difference signal to the third audio driver, wherein the second switch selects the stereo difference signal when the ground detection signal is not asserted;

a ground detect module, operatively coupled to the common terminal, for asserting the ground detection signal when the common terminal is coupled to a ground voltage;

a control module, operatively coupled to the first, second and third audio drivers, wherein the control module causes the first switch to select the right channel signal to be provided to the second audio driver when the ground detection signal is asserted, wherein the control module causes the second switch to select the left channel signal to be provided to the third audio driver when the ground detection signal is asserted, and wherein the control module disables the first audio driver when the ground detection signal is asserted;

wherein the second audio driver drives the right channel signal on the second terminal of the right headphone element when the ground detection signal is asserted; and wherein the third audio driver drives the left channel signal on the second terminal of the left headphone element when the ground detection signal is asserted.

6. The headphone driver of claim 5 wherein the first, second and third audio drivers provide direct current (DC) coupling to a headphone set.

7. A method comprising:

filtering a stereo sum signal with a corner frequency within an audio range and providing a filtered stereo sum signal;

driving the filtered stereo sum signal on a common terminal that is coupled to a first terminal of each of a right headphone element and a left headphone element;

high-pass filtering a right channel signal and providing a filtered right channel signal;

driving the filtered right channel signal on a second terminal of the right headphone element;

high-pass filtering a left channel signal and providing a filtered left channel signal;

driving the filtered left channel signal on a second terminal of the left headphone element;

asserting a ground detection signal when the common terminal is coupled to a ground voltage;

disabling the step of driving the filtered stereo sum signal when the ground detection signal is asserted;

disabling or bypassing filtering of the right channel signal when the ground detection signal is asserted so that the right channel signal is provided to the second terminal of the right headphone element; and disabling or bypassing filtering of the left channel signal when the ground detection signal is asserted so that the left channel signal is provided to the second terminal of the left headphone element.

8. The method of claim 7 wherein the step of high-pass filtering the right channel signal comprises high-pass filtering the right channel signal at a corner frequency within the audio range.

9. The method of claim 7 wherein the step of high-pass filtering the left channel signal comprises high-pass filtering the left channel signal at a corner frequency within the audio range.

10. The method of claim 7 wherein said driving comprises direct current (DC) coupling the signals to a headphone set.

* * * * *